United States Patent [19]

Kasai et al.

[11] Patent Number: 4,592,609

[45] Date of Patent: Jun. 3, 1986

[54] ELECTRICAL CONNECTOR

[75] Inventors: Junichi Kasai, Yokosuka; Takehiko Saito, Yamato, both of Japan

[73] Assignees: Nissan Motor Company, Limited, Kanagawa; Niles Parts Company, Limited, Tokyo, both of Japan

[21] Appl. No.: 587,915

[22] Filed: Mar. 9, 1984

[30] Foreign Application Priority Data

Mar. 24, 1983 [JP] Japan ..... 58-49279
Mar. 24, 1983 [JP] Japan ..... 58-49280

[51] Int. Cl.[4] ..... H01R 13/453

[52] U.S. Cl. ..... 339/42; 339/40; 339/116 R

[58] Field of Search ..... 339/40, 42, 43, 116 R, 339/114, 75 R

[56] References Cited

FOREIGN PATENT DOCUMENTS 169521 11/1951 Fed. Rep. of Germany ..... 339/42
556492 2/1957 Italy ..... 339/42

*Primary Examiner*—Gil Weidenfeld
*Assistant Examiner*—Paula A. Austin
*Attorney, Agent, or Firm*—Leydig, Voit & Mayer, Ltd.

[57] ABSTRACT

An electrical connector includes a male assembly and a female assembly matingly receiving the male assembly. Each of the male and female assemblies includes a protective member biased to normally cover the corresponding one of the male-side and female-side electrical terminals. When the male assembly is inserted into the female assembly, the male member pushes the female-side protective member into the housing of the female assembly against the biasing action imparted to the protective member. When the protective member of the male assembly is fully inserted into the housing, it is stopped by a shoulder provided in the housing. As the male assembly is further inserted into the female-side housing, it engages the inside surface of the housing. In that case, both the terminals of the male and female assemblies are exposed from the corresponding protective members and electrically engaged with each other.

12 Claims, 20 Drawing Figures

ELECTRICAL CONNECTOR

BACKGROUND OF THE INVENTION

This invention relates to a connector for connecting electrical conductors, and more particularly to an electrical connector which includes a male assembly and a female assembly which matingly receives the male assembly for electrical connection, each of the assemblies having a dust preventive device.

Usually, a conventional electrical connector includes a male assembly which includes an electrical terminal and a female assembly which also includes an electrical terminal. When the male and female assemblies are mated, the electrical terminals of the assemblies are urged into contact with each other whereas when they are separated, both of the terminals are exposed to the atmosphere. Thus, the other surfaces of the terminals may oxidize or become coated with dust from the local atmosphere, thereby causing incomplete electrical contact between the terminals and decreased service life.

Such connectors have been used for electrical connection of loudspeakers built into the tonneau board of a hatch-back passenger car, to corresponding amplifiers in another part of the vehicle. Usually, they are loosely placed within a parcel compartment defined by the tonneau board and its associated structural supports. Parcel compartments accumulate dust which is intermittently disturbed by vehicle vibrations and normal use. Thus, exposed terminals tend to become coated with dust quickly. If parcels are to be put into or removed from the compartment, the male and female assemblies must first, be separated before the tonneau board can be removed from the associated members to allow access to the parcel compartment. Otherwise, the wiring associated with the connectors and loudspeakers would hinder removal of the tonneau board. After the tonneau board is returned to place, the male and female assemblies must again be connected. This is very troublesome.

SUMMARY OF THE INVENTION

It is an object of the present invention to provide an electrical connector which eliminates the above drawbacks with the prior art connector.

According to the present invention, an electrical connector includes a male assembly and a female assembly which matingly receives the male assembly. Each of the assemblies includes a protective member which covers the corresponding electrical terminal when the assemblies are separated and which exposes the corresponding terminal when the assemblies are mated in order to allow the terminals to electrically contact each other, thereby protecting the terminals from dust and/or oxidation.

In a first preferred embodiment, the protective members take the form of a slider slidable along the corresponding one of male and female members of the male and female assemblies and biased to normally cover the corresponding one of the male-side and female-side electrical terminals. When the male assembly is inserted into the female assembly, the male member pushes the female-side slider into a housing of the female assembly against the biasing action imparted to the slider. When the slider of the male assembly is fully inserted into the housing, the male-side slider is stopped by a shoulder provided in the housing. As the male member is further inserted into the female-side housing, it engages the inside surface of the housing. In that case, both of the terminals of the male and female assemblies are exposed from the corresponding sliders and electrically engaged.

In a second embodiment, the protective members take the form of a cap provided at the open ends of each of the male and female members. The caps are capable of closing and opening the open ends and normally biased to close the corresponding open end. When the male assembly is inserted into the female assembly, first, the cap of the female member is opened by the male member and then the cap of the male member is opened by abutting an electrical insulator provided within the female member and extending toward the open end of the female member. Thus, the electrical terminals of the male and female assembly become electrically connected.

Thus, according to the present invention, when the male assembly is separated from the female assembly, the electrical terminals of the assemblies are covered by the movable covers, so that they are protected from oxidation and have prolonged service life. Thus, the connector according to the present invention is quite suitable for use in dusty environments.

While being plugged together, one electrical terminal slides along the surface of the other electrical terminal while applying a slight force to same, so that the sliders can remove oxides deposited on the terminals due to incomplete sealing, thereby bringing about good electrical contact between them.

The male and female assemblies of the connector according to the present invention can be installed in separable elements of a structure such as a vehicle tonneau board and its associated structural members, which define a parcel compartment, for connection to their corresponding loudspeakers. Thus, attachment and detachment of the tonneau board with its associated members in order to gain access to the parcel compartment automatically results in the necessary connection and disconnection of the male and female assemblies of the connectors. This eliminates the problem mentioned with respect to the prior art.

This and other objects, features and advantages of the present invention will be apparent from the following description with respect to preferred embodiments thereof taken in conjunction with the accompanying drawings.

DETAILED DESCRIPTION OF THE PREFERRED EMBODIMENTS

Figure 1:
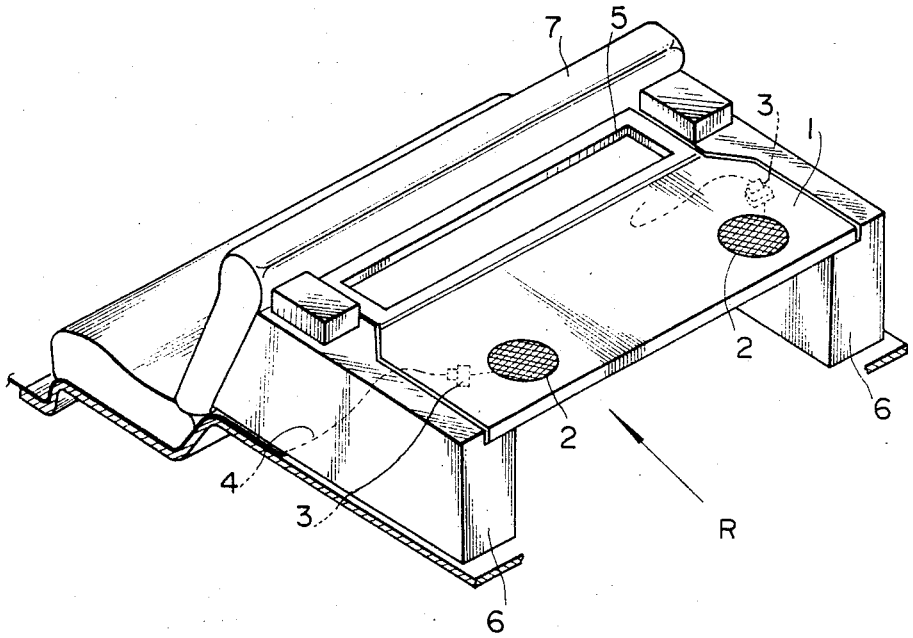
FIG.1 (PRIOR ART)
FIG. 1 is a perspective view of a part of the vehicle in which prior art connectors are used.

In order to facilitate understanding of the present invention, the prior art electrical connector mentioned above will be described. The connectors illustrated in FIG. 1 are especially for automotive vehicle applications and in particular for loudspeaker wiring installed on the tonneau board of a hatch-back passenger car. The rear compartment of the car includes a parcel compartment R between the rear inner trims 6 and behind the rear seat. The parcel compartment R is enclosed by a rear parcel shelf 5 which bridges inner trims 6 and a tonneau board 1 to which a pair of loudspeakers 2 are fixed. These loudspeakers are connected to corresponding amplifiers (not shown) via corresponding cables 4. The cables have the corresponding conventional electrical connectors loosely placed within the compartment. Each connector 3 includes a male or plug assembly and a female or receptacle assembly matingly receiving the plug assembly. The assemblies must be manually separated before the tonneau board can be opened or removed from the associated trims in order to put parcels into or take parcels out of the compartment. Otherwise, the cables would hinder such operations. Then, the tonneau board can be replaced and the male and female assemblies must be reconnected. However, this is troublesome. The present invention is intended to eliminate drawbacks mentioned above and in the introduction part of this specification.

Figure 2A:
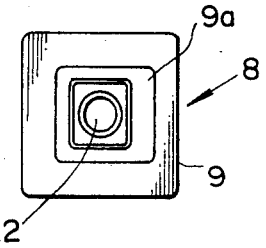
FIGS. 2A, 2B, and 2C are plan, side and bottom views, respectively, of a preferred embodiment of a female assembly of an electrical connector according to this invention.
Figure 2B:
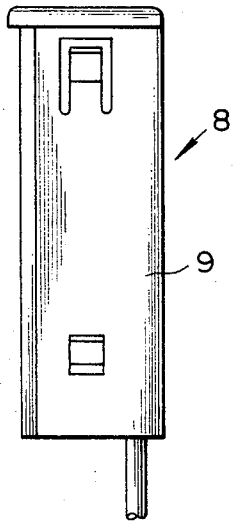
Figure 4A:
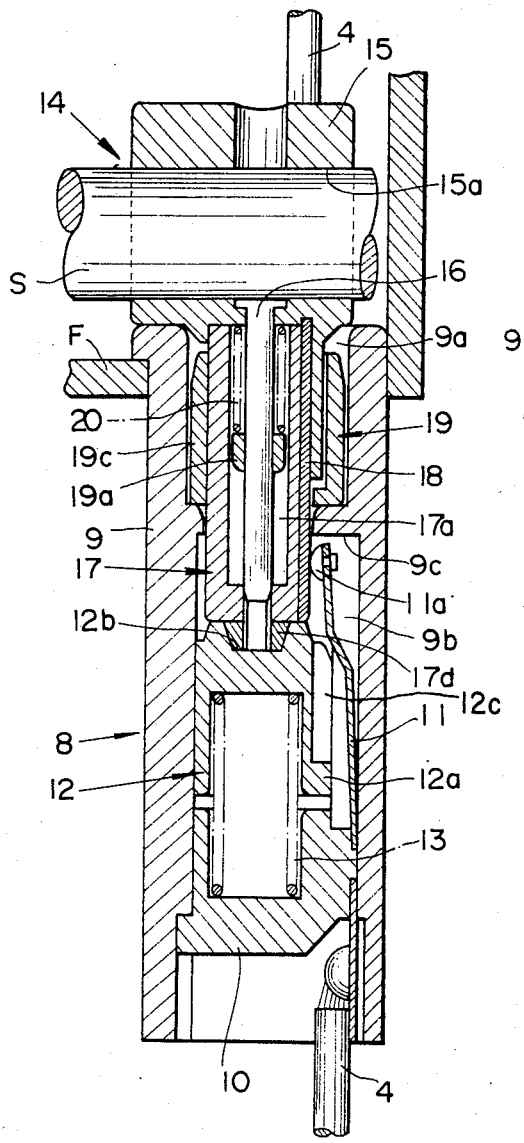
FIGS. 4A and 4B are cross-sectional views taken along lines A—A and lines B—B respectively, of FIGS. 2C and 3C, when the male and female assemblies are connected.
Figure 4B:
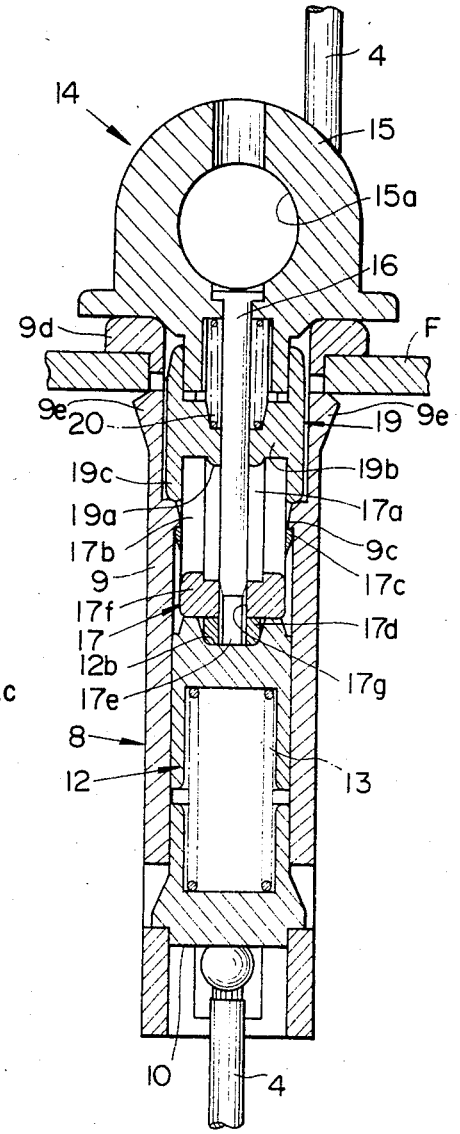

The present invention will be described with respect to a first preferred embodiment thereof in conjunction with the drawings in which the same reference numerals are used to denote the same or similar members throughout all the drawings and will not repeatedly be described. The receptacle or female assembly 8 of the connector according to the present invention will be described with reference to FIGS. 2A, 2B, 2C and 4A, 4B. Receptacle 8 includes a hollow, rectangular, columnar housing 9 which has one open end as shown at 9*a* in FIG. 2A and the other end is closed by a cup-like bottom member 10 as shown in FIGS. 4A and 4B. Housing 9 is provided on its inner surface with a longitudinal groove 9*b* which accommodates an elongated electrical terminal 11 made of a resilient conductor and firmly secured at one end by bottom member 10 to the inner surface of the housing. The free end of terminal 11 is bent slightly inward so that the free end, which is capped with a hemispheric contact 11*a*, projects slightly out of the groove. Housing 9 has a shoulder 9*c* on its inner surface at the end of groove 9*b* nearer the open end of the housing, thereby defining a reduced opening.

A protective member such as cup-like slider 12 is provided within housing 9 between bottom 10 and shoulder 9*c*. One side of slider 12 has a flange 12*a* which slides along on the edges of groove 9*b*, and the opposite side slides along the adjacent inner surface of housing 9. Slider 12 also has a recess 12*b* on its top surface and a projection 12*c* on its one outer surface, as shown in FIG. 4A. A spring 13 is seated between slider 12 and bottom member 10 for biasing slider 12 toward the reduced opening of housing 9. Thus, spring 13 urges slider 12 against shoulder 9*c* when the plug and receptacle assemblies are not connected, slider 12 thereby closing the reduced opening 9*a* of housing 9 and covering the free end of terminal 11.

On the other hand, as shown in FIGS. 3A–3C and 4A, 4B, plug assembly 14 has a head 15 which has a through hole 15*a* through which a mounting rod S, disposed on the side of tonneau board 1, is inserted for connection of plug assembly 14 to tonneau board 1. Plug or male assembly 14 includes a rod-like guide 16 and a male member or a hollow, rectangular columnar stem 17 enclosing the insert coaxially, both extending from head 15, reference numeral 17*a* denoting the space between rod 16 and stem 17. Stem 17 is long enough to push slider 12 of receptacle 8 down to a predetermined position within receptacle 8 and is wide enough to allow the stem to slidably pass through the reduced opening of housing 9 defined by shoulder 9*c*. Stem 17 is provided on its outer surface with an axially extending elongated electrical terminal 18 which electrically contacts electrical terminal 11 of female assembly 8 when the male and female assemblies are connected. Stem 17 is also provided with a stop 17*c* on its outer surface to normally prevent male assembly 14 from inadvertently disengaging from female assembly 8. The lower end 17*f* of stem 17 has a female-threaded hole 17*g* which receives the lower end of guide 16 and an male-threaded fitting 17*e* which is firmly connected to the lower end of guide 16 by a nut 17*d*. Nut 17*d* is received in recess 12*b* in top of slider 12 of female assembly 8 when the male and female assemblies are connected.

A protective member such as a slider 19 is slidably attached to stem 17. Slider 19 is provided with an inner ring core 19*a* which slides over guide 16, a plurality of arms 19*b* extending radially from inner ring 19*a* and received slidably in corresponding slits 17*b* provided in hollow stem 17, and an outer hollow rectangular column 19*c* integral with radial arms 19*b*, which slides along the outer surface of stem 17. Outer column 19*c* is so dimensioned as to be received within the opening 9*a* of female housing 9 and is long enough to cover the exposed portion of male electrical terminal 18 when slid fully downward when the male and female assemblies are disconnected. Slider 19 is provided with axial grooves (not shown) on its inner surface opposite stops 17*c* so as not to be hindered by stops 17*c*.

A spring 20 is seated between head 15 and slider 19 to bias slider 19 downward. An upper and a lower cable 4 are connected to male and female side terminals 18 and 11, respectively.

Figure 5:
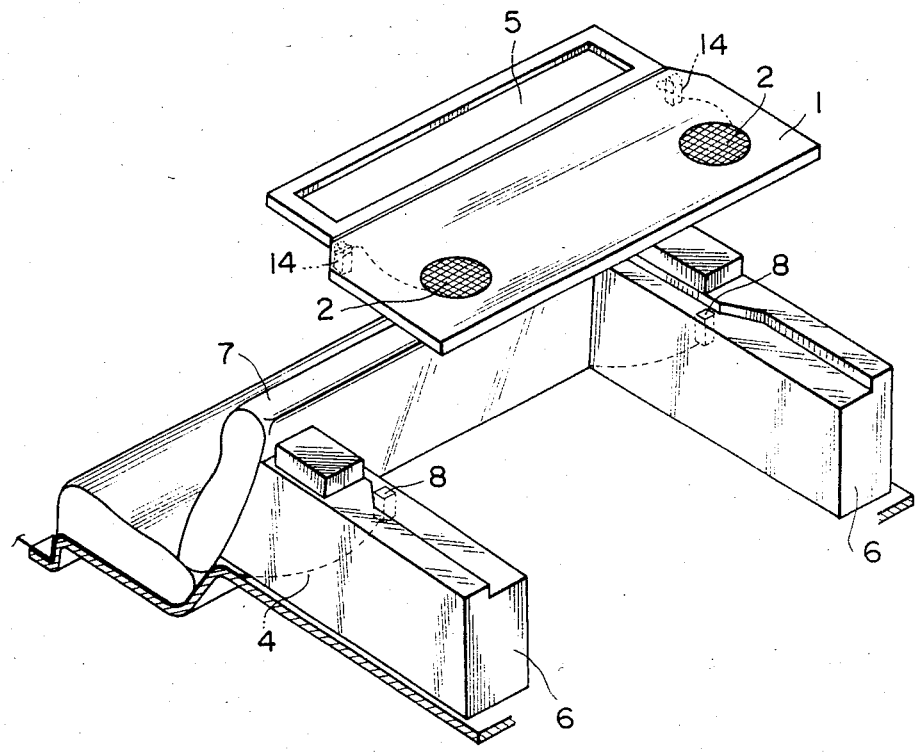
FIG. 5 is a perspective view of the separated members of the vehicle in which the connectors of this invention are used.

When the connectors according to the present invention are used for wiring of amplifiers (not shown) and loudspeakers 2 installed on the tonneau board 1 of the hatch-back passenger car, as shown in FIG. 5, receptacles 8 of the connectors are built into the rear inner trims 6, for example, by inserting housing 9 into a hole in a mounting damper F wherein a flange 9*d* of housing 9 and resilient protrusions 9*e* provided around the outer periphery of housing 9 cooperate to firmly secure housing 9 to damper F. Signal cables 4 from a amplifiers (not shown) are soldered to the terminals 11 of receptacles 8. Plugs 14 are firmly secured to tonneau board 1 by means of a common mounting rod S passing through holes 15*a* in plug heads 15 and secured to tonneau board 1 at points opposite receptacles 8 when tonneau board 1 is carefully positioned over trims 6, as shown in FIG. 4. The signal cables 4 extending from loudspeakers 2 are soldered to terminal 18.

Figure 3A:
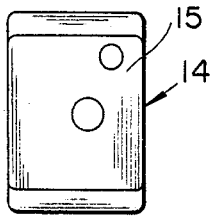
FIGS. 3A, 3B and 3C are views, similar to FIGS. 2A to 2C of a preferred embodiment of a male assembly of the connector.
Figure 3B:
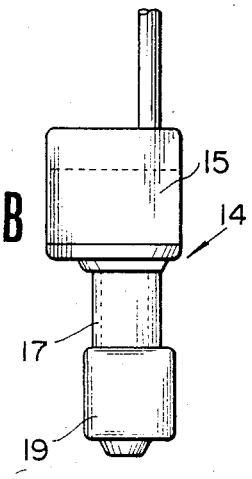
Figure 2C:
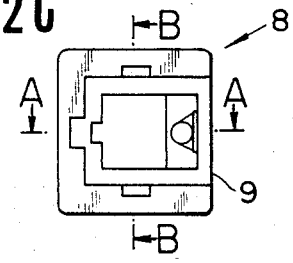
Figure 3C:
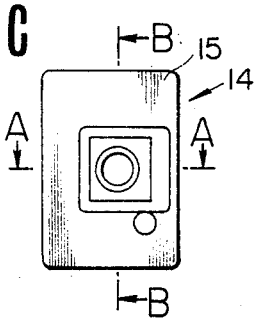

Before columnar stem 17 of plug assembly 14 is inserted into the housing of receptacle assembly 8, slider 12 of receptacle assembly 8 is in a positon where the slider tip is urged against shoulder 9*c*, thereby closing the reduced opening 9*a* of housing 8 and covering the free end of electrical terminal 11 whereas slider 19 of plug assembly 14 is in a position to cover the terminal 18 thereof, as shown in FIG. 3B.

When insert 17 of plug assembly 14 is first inserted via open end 9*a* into housing 9, nut 17*d* provided at the tip of insert 17 first fits in recess 12*b* of female assembly slider 12, and then nut 17*d* and the insert 17 push female-side slider 12 into housing 9, thereby exposing terminal 11 which was previously covered by slider 12. When the projection 12*c* of female assembly slider 12 leaves the surface of the terminal 11 and returns to the rest position shown in FIG. 4A, the hemispheric contact 11*a* strikes and slides along the outer surface of the electrical terminal 18 by action of the resiliency of the terminal 11. The axial length of a mutual contact area (in this case, a point between the hemispheric contact 11*a* and the flat electrical terminal 18) is shorter than a slide distance (i.e., the axial separation between the projection 12*c* and the terminal 11) of the contact 11*a* along the outer surface of the electrical terminal 18.

After slider 19 of male assembly 14 abuts shoulder 9*c* and thus is prevented from being inserted farther, so that slider 19 retracts relative to stem 17 and hence terminal 18. As a result, male-side terminal 18 slides along contact 11*a* of terminal 11.

When bump 17*c* on columnar insert 17 passes over shoulder 9*c* of housing 9, bump 17*c* engages shoulder 9*c*, so that bump 17*c* cannot easily be removed from shoulder 9*c*, ensuring engagement between male assembly 14 and female assembly 8. Contact 11*a* of female-side terminal 11 is in press contact with male terminal 18. That is, installation of tonneau board 1 simultaneously effects electrical connection of loudspeakers 2 to the corresponding amplifiers.

When tonneau board 1 is to be removed, it should be lifted upwardly, which breakes the mutual engagement of shoulder 9*c* and bump 17*c*, so that male assembly 14 firmly secured to tonneau board 1 becomes detached from female assembly 8. As a result, female-side slider 12 is biased by spring 13 to shift toward shoulder 9*c* until its tip abuts shoulder 9*c* as before insertion, thereby closing the reduced opening end 9*a* at shoulder 9*c* and covering the free end of terminal 11, which serves to prevent oxidation of and deposition of dust on terminal 11.

On the other hand, simultaneously with the movement of female-side slider 12, male-side slider 19 is shifted by the action of spring 20 disposed coaxially about guide 16 in the interior space of cylindrical insert 17 between head 15 and slider 19 and covers the exposed portion of terminal 18 at a point where inner ring core 19*a* and radial arms 19*b* abut the closed lower end of insert 17, thereby preventing oxidation of and deposition of dust on terminal 18, as before insertion.

A second embodiment of the connector according to the present invention will be described with reference to FIGS. 6A, 6B, 6C; 7A, 7B, 7C; 8A, 8B; and 9A, 9B.

Figure 6A:
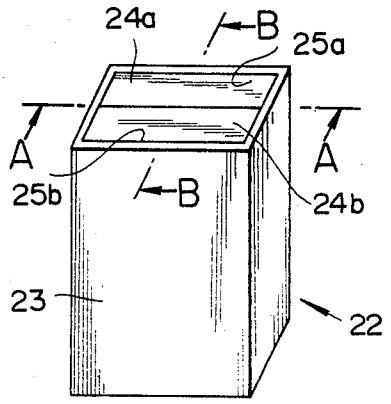
FIGS. 6A, 6B and 6C are respectively a perspective view of a female assembly of one embodiment of this invention, and cross-sectional views taken along lines A—A and B—B of FIG. 6A.
Figure 6B:
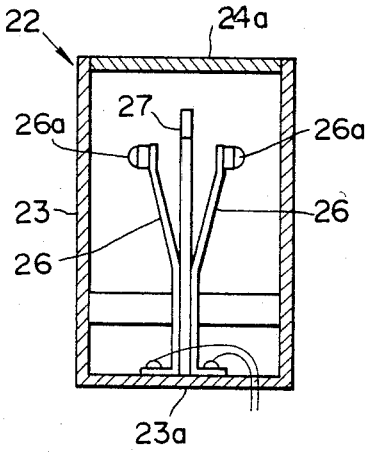
Figure 6C:
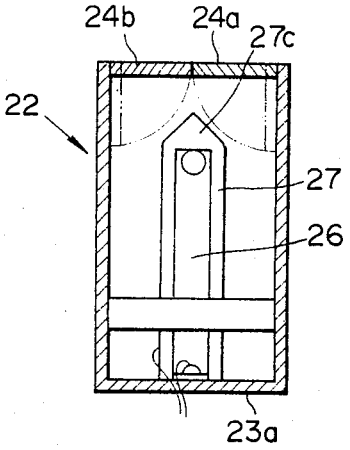

As shown in FIGS. 6A–6C, housing 23 of female assembly 22 of the connector is in the form of a box which has a pair of rectangular plate-like half-caps 24*a*, 24*b*. These half-caps are hinged at opposite remote edges 25*a*, 25*b* to the adjacent edges of the opening of the box and normally biased to close the opening of the box by pivotting until their free edges meet.

A pair of opposing, strip-like, resilient electrical terminals 26 stand upright from the bottom 23*a* of the box. The terminals each have a protruding contact 26*a* at their upper end and are bent partway along their lengths so that their upper ends are slightly separated. An upright strip-like insulator 27 isolating the terminals 26 has a tapered top 27*c*, and is slightly wider and longer than the terminals 26.

Figure 7A:
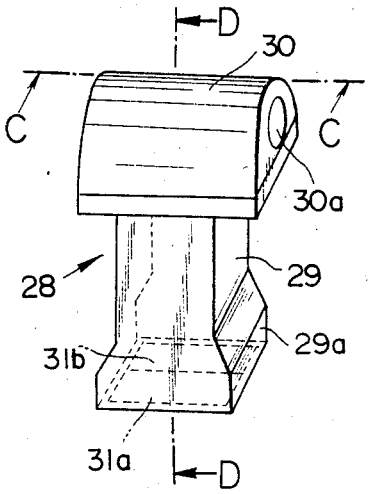
FIGS. 7A, 7B and 7C are respectively a perspective view of a male assembly of one embodiment of the connector according to this invention, and cross-sectional views taken along lines C—C and D—D of FIG. 7A.
Figure 7B:
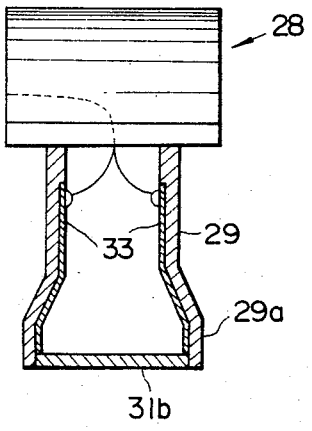
Figure 7C:
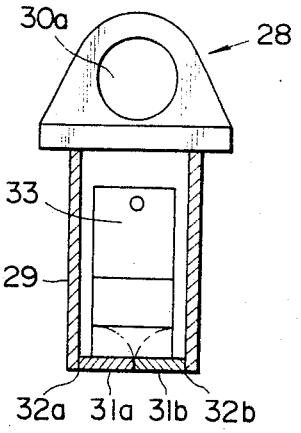

On the other hand, as shown in FIGS. 7A, 7B, 7C, male assembly 28 includes a hollow stem 29 and a head 30 which has a through hole 30*a* through which a mounting rod such as shown by S in FIG. 4A is inserted. The hollow stem 29 has a rectangular cross-section which flares out slightly at its open end 29*a* distal from the head 30. The width of the stem 29 at its lower, open end 29*a* is just wide enough to slide snugly inside the female-side housing 23. A pair of plate-like half-caps 31*a*, 31*b* are hinged at their remote edges 32*a*, 32*b* to the adjacent edges of the open end of the stem and biassed to normally close the open end of stem 29 by pivotting until their free ends meet. A pair of electrical terminals 33 are fixed to opposite inside walls of stem 29 so that when the connectors 22 and 28 are pressed together, the contacts 26*a* of terminals 26 in female-side housing 23 slide along terminals 33 until they reach the narrower, unflared section of stem 29. In this position, the resilient terminals 26 are compressed slightly, which ensures a positive electrical connection between terminals 26 and 33.

Figure 8A:
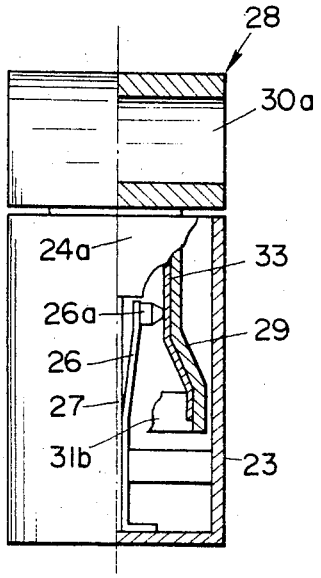
FIGS. 8A and 8B are partial cross-sectional elevations of the connector according to this invention, as viewed in two orthogonal directions.
Figure 8B:
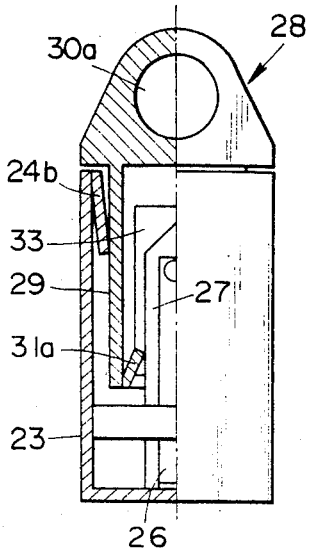

The second embodiment of the connector may be mounted on the tonneau board and its associated members in the same manner as shown in FIG. 5. In that case, the female housing 23 is firmly secured to the corresponding inner trim 6 in a well-known manner. When the male-side stem 29 is first inserted into female-side housing 23, the half-caps 24*a*, 24*b* of female-side housing 23 are pushed open inward, thereby allowing the male-side stem 29 to be further inserted into the female-side housing. On the other hand, as male-side stem 29 is inserted, the half-caps 31*a*, 31*b* abut and then are pushed open inward by the tapered top 29*c* of insulator 27. This allows female-side terminals 26 to be inserted into the male-side stem 29, so that the contacts 26*a* slide along corresponding terminals 33. When the male assembly 28 has been fully inserted into the female assembly 22, both the half-caps 24*a*, 24*b* and 31*a*, 31*b* are fully opened inwards and the male-side stem 29 is inserted into the female-side housing 16, while the female-side terminals 26 inserted into the male-side stem 29 contact the male-side terminals 33, as shown in FIGS. 8A, 8B. That is, installation of tonneau board simultaneously causes electrical connection of loudspeakers 2 to corresponding amplifiers.

Lifting the tonneau board, as shown in FIG. 5, causes the male assembly 28 to be detached from the female assembly 22, so that both the half-caps 24*a*, 24*b* and 31*a*, 31*b* fully close the corresponding opening ends of housing 23 and stem 29, thereby preventing oxidation and deposition of dust on the terminals.

Figure 9A:
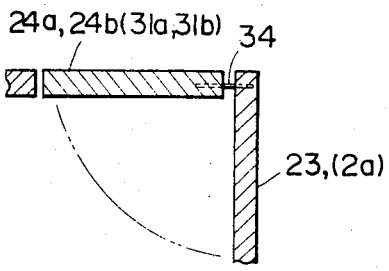
FIGS. 9A and 9B illustrate the different way of mounting caps for the male and female assemblies.
Figure 9B:
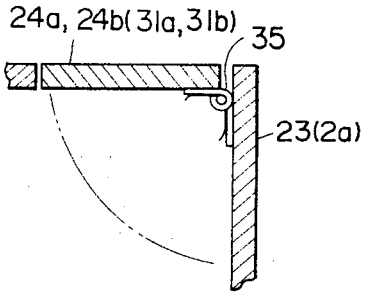

As the hinging and biasing mechanisms for both the half-caps, plate-like hinges 34 of flexible and resilient synthetic resin or metal material may be embedded in the half-caps 24*a*, 24*b* or 31*a*, 31*b* and the corresponding edges of the open ends of housing 23 and stem 29, as shown in FIG. 9A. Alternatively, a hinge with an L-shaped return spring 35 may be fixed to each of the half-caps 24*a*, 24*b* or 31*a*, 31*b* and to the corresponding edge of the open ends of housing 23 or stem 29 so as to apply a return force in the direction of closing the half-caps.

While the present invention has been shown and described in terms of preferred embodiments thereof, it should be noted that the invention is not limited to these. Various changes and modifications could be made by those skilled in the art without departing from the scope of the invention as set forth in the attached claims.

What is claimed is:

1. An electrical connector comprising a male assembly and a female assembly matingly receiving said male assembly:

(a) said male assembly comprising:

(1) a male member;

(2) a first electrical terminal means provided on said male member;

(3) a first protective member provided on said male member for protecting said terminal means from oxidation and/or deposition of dust, said protective member being movable relative to said terminal means such that said terminal means is exposed by said protective member when said male and female assemblies are mated and such that said terminal is covered by said protective member when said male and female assemblies are separated; and (b) said female assembly comprising:

(1) a female member for matingly receiving said male member;

(2) a second electrical terminal means provided in said female member; and (3) a second protective member provided in said female member for protecting said second terminal means from oxidation and/or deposition of dust, said second protective member being movable such that said second terminal means is exposed by said second protective member to allow electrical connection with said first terminal means when said male and female assemblies are mated and that said second terminal means is covered by said second protective member when said male and female assemblies are separated;

said male member including a rod-like guide, said first protective member including a hollow columnar portion slidable along said guide, said male member including a hollow stem having a plurality of slits extending along the axis of said stem, said protective member including a ring-like core which fits slidably over said rod-like guide and is coaxial with said hollow portion, a plurality of radial arms connecting said hollow portion and said ring-like core, said radial arms being slidably received in the corresponding slits of said stem.

2. An electrical connector according to claim 1, further including means disposed between one end of said hollow stem and said protective member for biasing said protective member so as to cover said first terminal means of said male assembly when said male assembly is not engaged with said female assembly.

3. An electrical connector according to claim 2, further including a head integral with said one end of said stem and having a through hole through which a fixing rod can pass for firmly securing said male assembly to a support structure.

4. An electrical connector according to claim 2, wherein the other end of said hollow stem includes means for preventing said protective member from being displaced.

5. An electrical connector according to claim 4, wherein said preventing means includes a closed end constituting the other end of said stem.

6. An electrical connector according to claim 5, further including means for firmly securing said rod-like guide to said closed end of said stem.

7. An electrical connector according to claim 6, wherein said closed end of said stem includes a center hole for receiving said guide, said center hole having female threads, said securing means includes a male-threaded stem screwed into said female-threaded center hole and receiving a nut thereon in order to urge said guide against said closed end of said stem.

8. An electrical connector comprising a male assembly and a female assembly matingly receiving said male assembly:

(a) said male assembly comprising:

(1) a male member;

(2) a first electrical terminal means provided on said male member; and (3) a first protective member provided on said male member for protecting said terminal means from oxidation and/or deposition of dust, said protective member being movable relative to said terminal means such that said terminal means is exposed by said protective member when said male and female assemblies are mated and such that said terminal means is covered by said protective member when said male and female assemblies are separated; and (b) said female assembly comprising:

(1) a female member for matingly receiving said male member;

(2) a second electrical terminal means provided in said female member; and (3) a second protective member provided in said female member for protecting said second terminal means from oxidation and/or deposition of dust, said second protective member being movable such that said second terminal means is exposed by said second protective member to allow electrical connection with said first terminal means when said male and female assemblies are mated and that said second terminal means is covered by said second protective member when said male and female assemblies are separated, wherein said male member includes a head having a through hole, a fixing rod extending through said hole, a hollow stem firmly secured at one end to said head and having an open end, said first terminal means being fixed to the inside surface of said hollow stem, and a cover member hinged at said stem open end so as to normally close said open end, and wherein said female member includes a hollow columnar housing slightly larger in cross-section than said hollow stem and having an open and a closed end, a second cover member hinged at said second open end of said hollow housing so as to normally close said second open end, and an electrical insulator extending parallel to the axis of said housing, one end of said second terminal means being attached to said insulator and the other end being resiliently urged away from said insulator and toward the walls of said housing, whereby when said male member is inserted into said housing of said female member, said second cover at said second open end of said housing is urged into said second open end whereas said electrical insulator is urged into said hollow stem by urging said first cover into said hollow stem, so that said first terminal engages said second terminal.

9. An electrical connector according to claim 8, wherein said first and second caps each include a pair of half caps normally forming a single closed surface at each of said stem and housing open ends, each pair being separated and displaced into the corresponding opening by the corresponding one of said stem and said insulator.

10. An electrical connector according to claim 9, further including a resilient member connecting each of said pair of half-caps to the adjacent edge of the opening of each of said stem and housing so that each of said pair of half-caps can pivot around the point where each of said pair of half-caps is connected to the adjacent edge of said stem and housing.

11. An electrical connector according to claim 10, wherein said resilient member has a strip-like hinge having ends embedded in the adjacent corresponding half-cap and edge of said stem and housing.

12. An electrical connector according to claim 10, wherein said resilient member has an L-shaped spring hinge.

* * * * *